US009073332B2

(12) United States Patent
Nishikawa

(10) Patent No.: US 9,073,332 B2
(45) Date of Patent: Jul. 7, 2015

(54) INKJET RECORDING APPARATUS, MULTIFUNCTION DEVICE, AND INK CARTRIDGE CONTAINER

(71) Applicant: BROTHER KOGYO KABUSHIKI KAISHA, Nagoya-shi, Aichi-ken (JP)

(72) Inventor: Yasuo Nishikawa, Nagoya (JP)

(73) Assignee: BROTHER KOGYO KABUSHIKI KAISHA, Nagoya-Shi, Aichi-Ken ( * ) Notice: Subject to any disclaimer, the term of this patent is extended or adjusted under 35 U.S.C. 154(b) by 0 days.

(21) Appl. No.: 14/501,336

(22) Filed: Sep. 30, 2014

(65) Prior Publication Data

US 2015/0158306 A1 Jun. 11, 2015

(51) Int. Cl.
*B41J 29/13* (2006.01)
*B41J 3/00* (2006.01)
*B41J 2/175* (2006.01)

(52) U.S. Cl.
CPC ..... *B41J 2/1752* (2013.01)

(58) Field of Classification Search
USPC ..... 347/2, 3, 4, 7, 85, 86, 108
See application file for complete search history.

(56) References Cited

U.S. PATENT DOCUMENTS

| | | | | |
|---|---|---|---|---|
| 5,843,294 | A * | 12/1998 | Allington | 204/453 |
| 7,393,087 | B2 * | 7/2008 | Iijima et al. | 347/84 |
| 7,407,243 | B2 * | 8/2008 | Sadano | 347/7 |
| 8,226,123 | B2 * | 7/2012 | Chino et al. | 280/830 |
| 8,910,675 | B2 * | 12/2014 | Coulon et al. | 141/198 |

FOREIGN PATENT DOCUMENTS

| | | |
|---|---|---|
| JP | 8-217155 A | 8/1996 |
| JP | 2010-222052 A | 10/2010 |

* cited by examiner

*Primary Examiner* — Anh T. N. Vo
(74) *Attorney, Agent, or Firm* — Merchant & Gould PC

(57) ABSTRACT

An inkjet recording apparatus, including an ink cartridge, an ink cartridge container, a tray with a supporting surface, and a slider member, is provided. The slider member is slidable on the supporting surface along a first direction, which is an orientation from a front side toward a rear side of the inkjet recording apparatus, or a second direction, which is an orientation orthogonal to the first direction. The ink cartridge container includes a container compartment to contain the ink cartridge in a position on at least one of an upstream side and a downstream side of the slider member with regard to the second direction, and a bridging section connected with the container compartment and placed on an upstream side of the slider member with regard to the first direction in a position to spread over the slider member with regard to the second direction.

16 Claims, 11 Drawing Sheets

INKJET RECORDING APPARATUS, MULTIFUNCTION DEVICE, AND INK CARTRIDGE CONTAINER

CROSS REFERENCE TO RELATED APPLICATION

This application claims priority from Japanese Patent Application No. 2013-253683, filed on Dec. 6, 2013, the entire subject matter of which is incorporated herein by reference.

BACKGROUND

1. Technical Field

An aspect of the present invention relates to an inkjet recording apparatus capable of recording an image on a recording medium by discharging ink droplets through a nozzle, a multifunction device including the inkjet recording apparatus, and an ink cartridge container capable of accommodating an ink cartridge containing the ink.

2. Related Art

An inkjet recording apparatus for recording an image onto a recording medium by discharging droplets of ink through a nozzle which is disposed in a recording head is known. The inkjet recording apparatus is often configured to have a detachable ink cartridge, in which the ink to be supplied to the recording head is stored, mounted thereon.

The inkjet recording apparatus accompanying the ink cartridge may often be shipped in a container box such as a cardboard box. In this regard, while the inkjet printer may occupy a large part of the container box, the ink cartridge may be placed in the same container box aside in a spare room, which is reserved in the container box but outside the room to accommodate the inkjet recording apparatus.

SUMMARY

In the container or box, in other words, it may be necessary to create the spare room for the ink cartridge in addition to the space to accommodate the inkjet recording apparatus. Accordingly, a size of the container box may be increased for a volume of the spare room to accommodate the ink cartridge. Meanwhile, a volume of space to carry products including the inkjet apparatuses (e.g., cargo rooms in a ship, an airplane, and a train) may be limited. Therefore, the larger the container boxes become, the less the quantity of the products that can be transported in a batch is reduced to be. As a result, the larger the container boxes become, the more difficult it is to reduce transportation cost.

The present invention is advantageous in that an inkjet recording apparatus, by which the container box to pack the inkjet recording apparatus therein can be downsized, a multifunction peripheral device having the inkjet recording apparatus, and an inkjet cartridge container to accommodate an ink cartridge which is to be attached to the inkjet recording apparatus, are provided.

According to an aspect of the present invention, an inkjet recording apparatus is provided. The inkjet recording apparatus includes an ink cartridge; an ink cartridge container configured to contain the ink cartridge therein; a tray comprising a supporting surface configured to support one of a sheet and the ink cartridge container containing the ink cartridge; and a slider member configured to protrude from the supporting surface in the tray along a direction orthogonal to the supporting surface, the slider member being configured to be slidable on the supporting surface along one of a first direction and a second direction, the first direction being an orientation from a front side toward a rear side of the inkjet recording apparatus, and the second direction being an orientation orthogonal to the first direction. The ink cartridge container includes a container compartment, in which the ink cartridge is contained, in a position on at least one of an upstream side and a downstream side of the slider member with regard to the second direction; and a bridging section connected with the container compartment, the bridging section being placed on an upstream side of the slider member with regard to the first direction in a position to spread over the slider member with regard to the second direction.

According to another aspect of the present invention, a multifunction device including an inkjet recording apparatus, a scanner, a first sheet, and a second sheet is provided. The inkjet recording apparatus includes an ink cartridge; an ink cartridge container configured to contain the ink cartridge therein; a tray comprising a supporting surface configured to support one of a sheet and the ink cartridge container containing the ink cartridge; and a slider member configured to protrude from the supporting surface in the tray along a direction orthogonal to the supporting surface, the slider member being configured to be slidable on the supporting surface along one of a first direction and a second direction, the first direction being an orientation from a front side toward a rear side of the inkjet recording apparatus, and the second direction being an orientation orthogonal to the first direction. The ink cartridge container includes a container compartment, in which the ink cartridge is contained, in a position on at least one of an upstream side and a downstream side of the slider member with regard to the second direction; and a bridging section connected with the container compartment, the bridging section being placed on an upstream side of the slider member with regard to the first direction in a position to spread over the slider member with regard to the second direction. The scanner is disposed in an upper position than the inkjet recording apparatus along the direction orthogonal to the supporting surface. The scanner includes a platen glass, which is configured to support a sheet, and a cover, of which posture is changeable between a covering position to cover an upper side of the platen glass and an exposing position to expose the upper side the platen glass with regard to the direction orthogonal to the supporting surface. The first sheet is connected with an upstream end of the ink cartridge container supported by the tray with regard to the first direction and projects frontward of the inkjet recording apparatus from an upstream end of the tray with regard to the first direction to stretch upward along the direction orthogonal to the supporting surface. The second sheet is connected with the first sheet on an opposite side from the ink cartridge container and is placed in a position between the platen glass and the cover. When the multifunction device is packed in an upward orientation having the upstream side of the slider member with regard to the first direction facing upward with regard to a direction of gravity force, the first sheet covers a part of a front face of the inkjet recording apparatus.

According to another aspect of the present invention, an ink cartridge container is provided. The ink cartridge container is configured to contain ink cartridges for an inkjet recording apparatus, which includes a sheet tray to support the ink cartridge container. While the sheet tray includes a supporting surface and a slider member and is configured to support the ink cartridge container containing the ink cartridge, the slider member is configured to protrude from the supporting surface in the sheet tray along a direction orthogonal to the supporting surface and is configured to be slidable on the supporting surface along one of a first direction and a second direction.

The first direction is an orientation from a front side toward a rear side of the inkjet recording apparatus, and the second direction is an orientation orthogonal to the first direction. The ink cartridge container includes a plurality of container compartments configured to contain the ink cartridges therein; and a bridging section configured to connect the plurality of container compartments with one another. The ink cartridge container is supported by the sheet tray in a position on an upstream side and a downstream side of the slider member with regard to the second direction. The bridging section is placed on an upstream side of the slider member with regard to the first direction in a position to spread over the slider member with regard to the second direction.

BRIEF DESCRIPTION OF THE ACCOMPANYING DRAWINGS

Figure 3B:
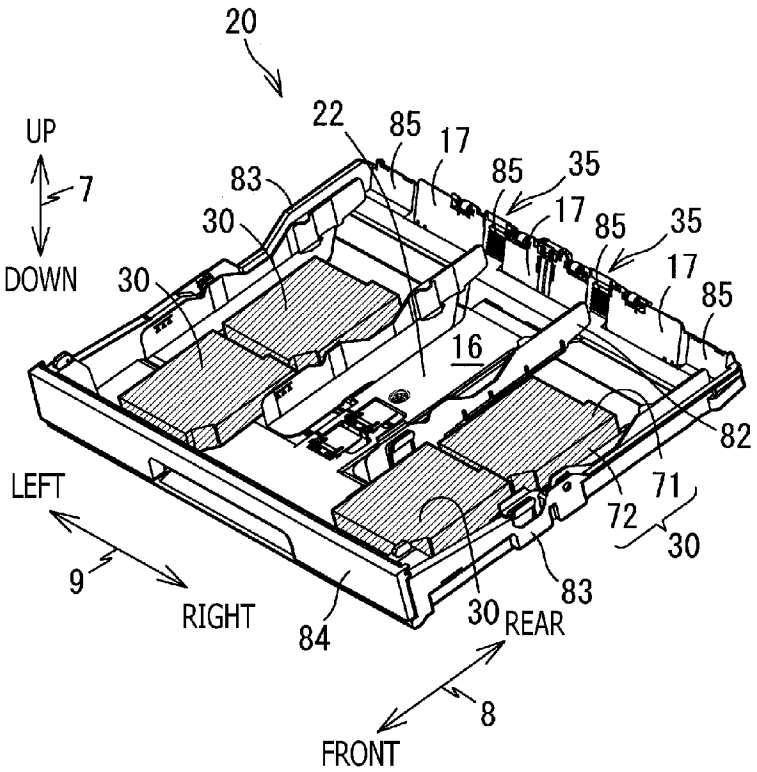
Figure 3A:
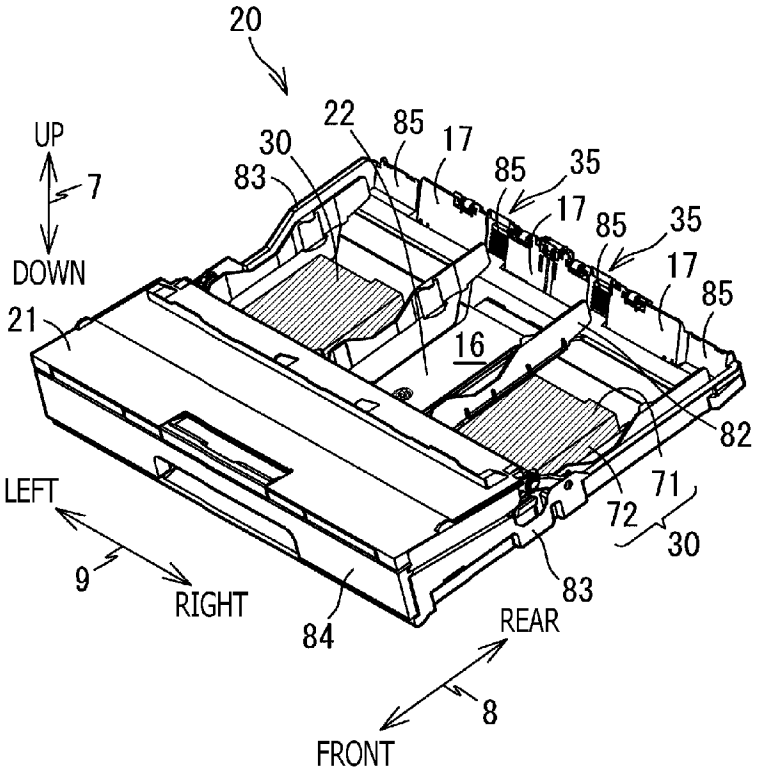

FIG. 3A is a perspective view of a feeder tray 20 supporting ink cartridges 30 and a discharge tray 21 according to the embodiment of the present invention. FIG. 3B is a perspective view of the feeder tray 20 supporting the ink cartridge 30 according to the embodiment of the present invention.

Figure 4B:
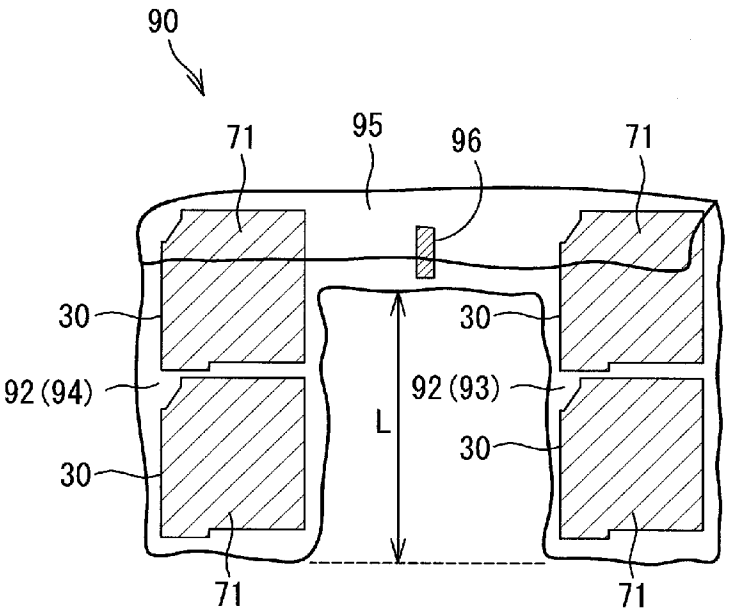
Figure 4A:
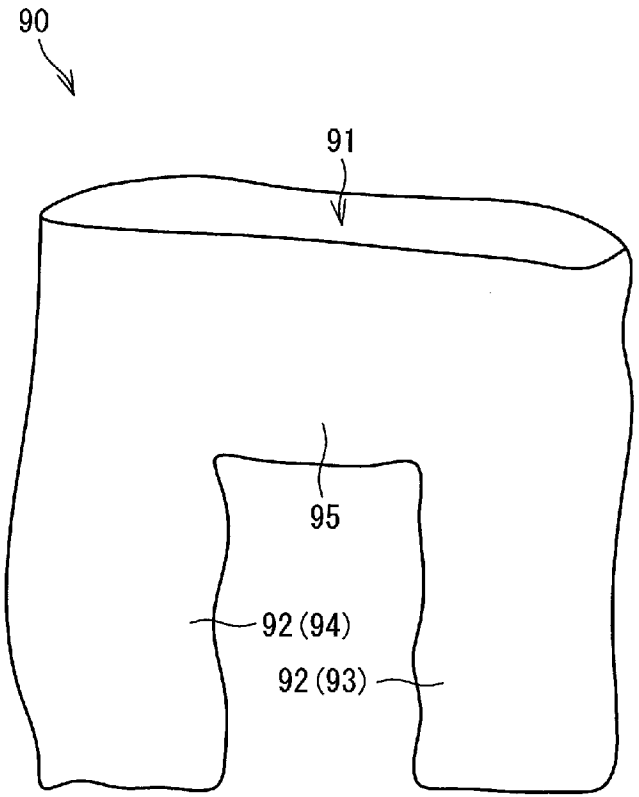

FIG. 4A is an external perspective view of an ink cartridge container 90 according to the embodiment of the present invention. FIG. 4B is a perspective view of the ink cartridge container 90 containing the ink cartridges 30 therein according to the embodiment of the present invention.

Figure 5:
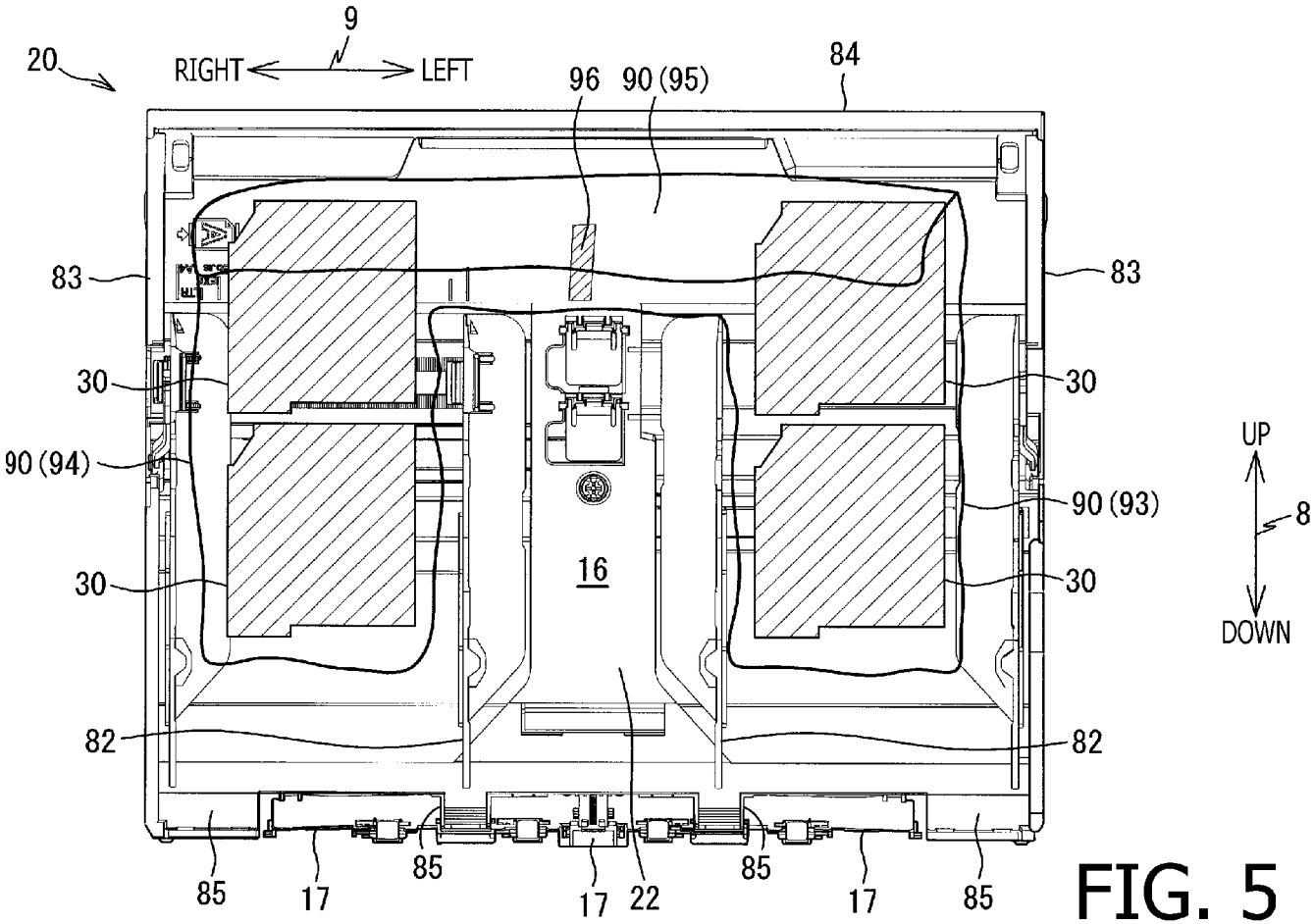

FIG. 5 is a plan view of the feeder tray 20 supporting the ink cartridge container 90 therein according to the embodiment of the present invention.

FIGS. 6A-6D are perspective views of the ink cartridge container 90 containing the ink cartridges 30 and lateral guides 82 according to modified examples of the present invention.

Figure 7B:
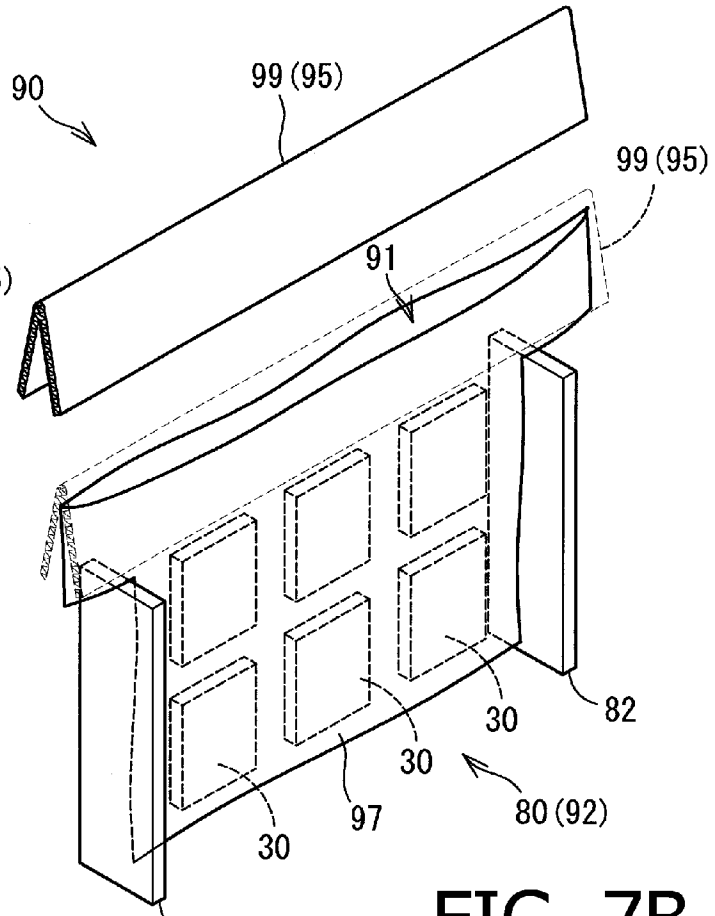
Figure 7A:
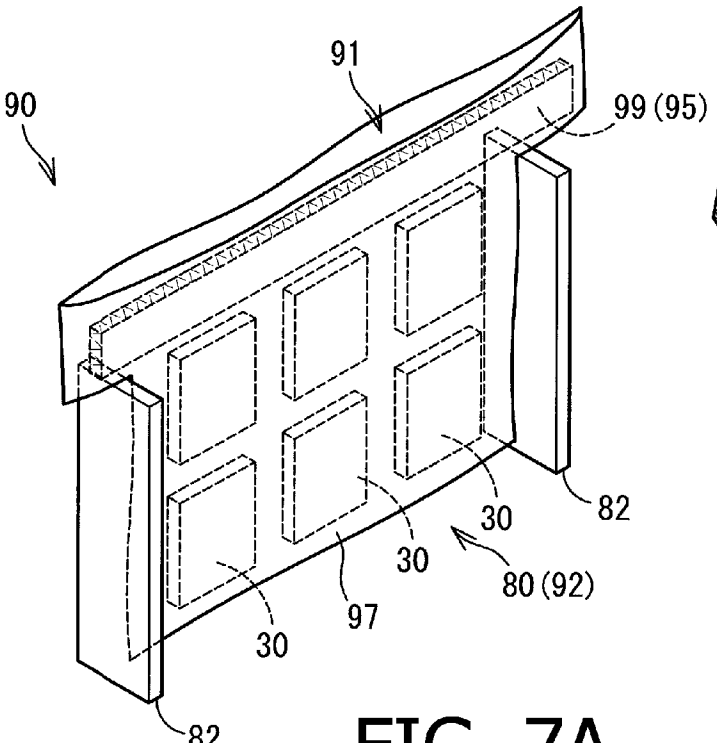

FIGS. 7A-7B are perspective views of the ink cartridge container 90 containing the ink cartridges 30 and the lateral guides 82 according to modified examples of the present invention.

Figure 8B:
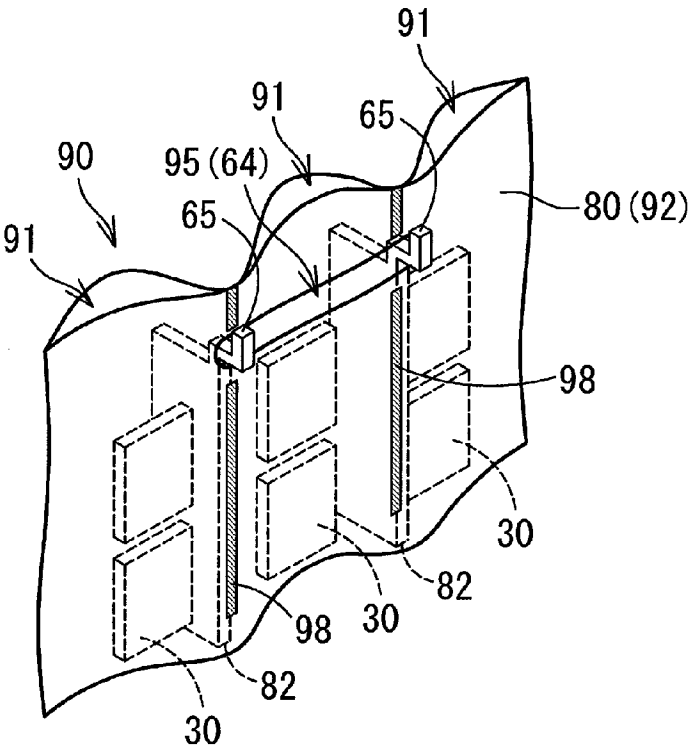
Figure 8A:
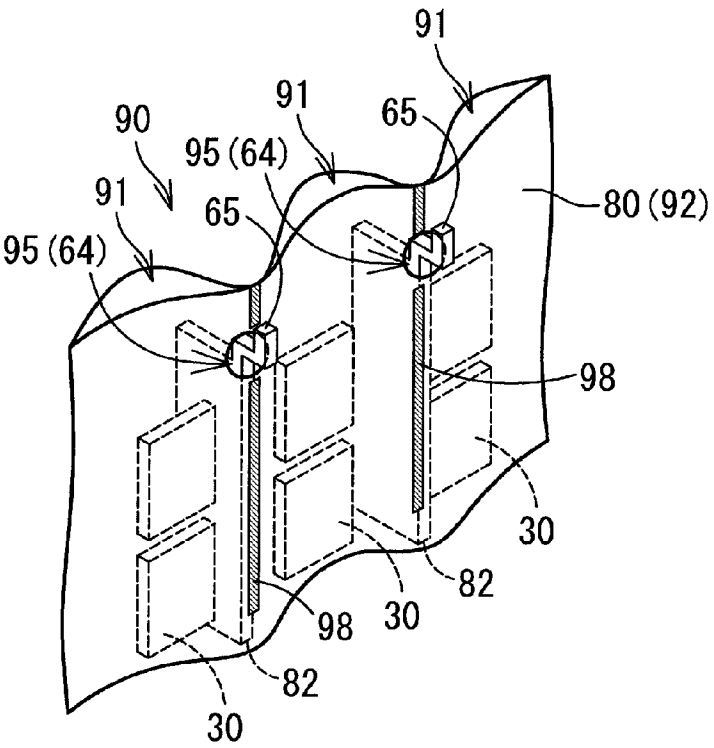

FIGS. 8A-8B are perspective views of the ink cartridge container 90 containing the ink cartridges 30 and the lateral guides 82 according to modified examples of the present invention.

Figure 9C:
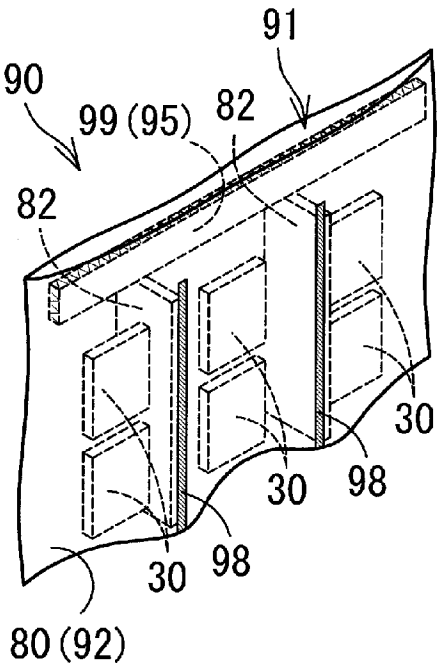
Figure 9B:
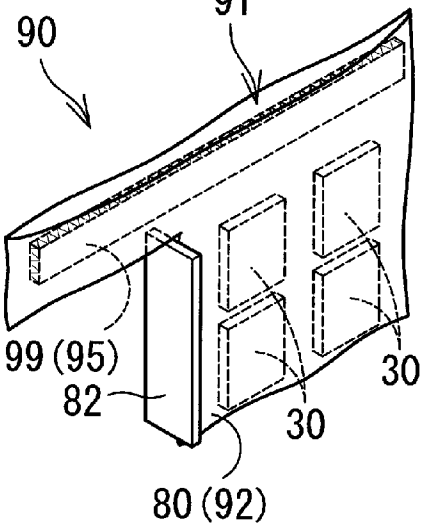
Figure 9A:
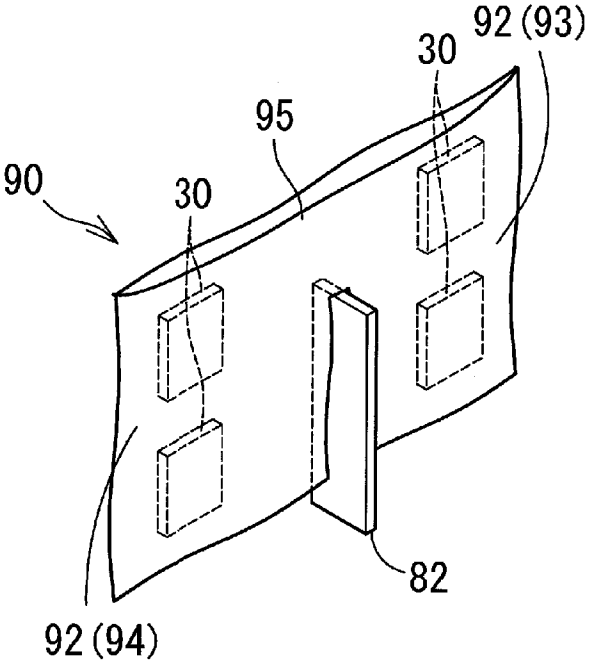

FIGS. 9A-9C are perspective views of the ink cartridge container 90 containing the ink cartridges 30 and the lateral guides 82 according to modified examples of the present invention.

Figure 10:
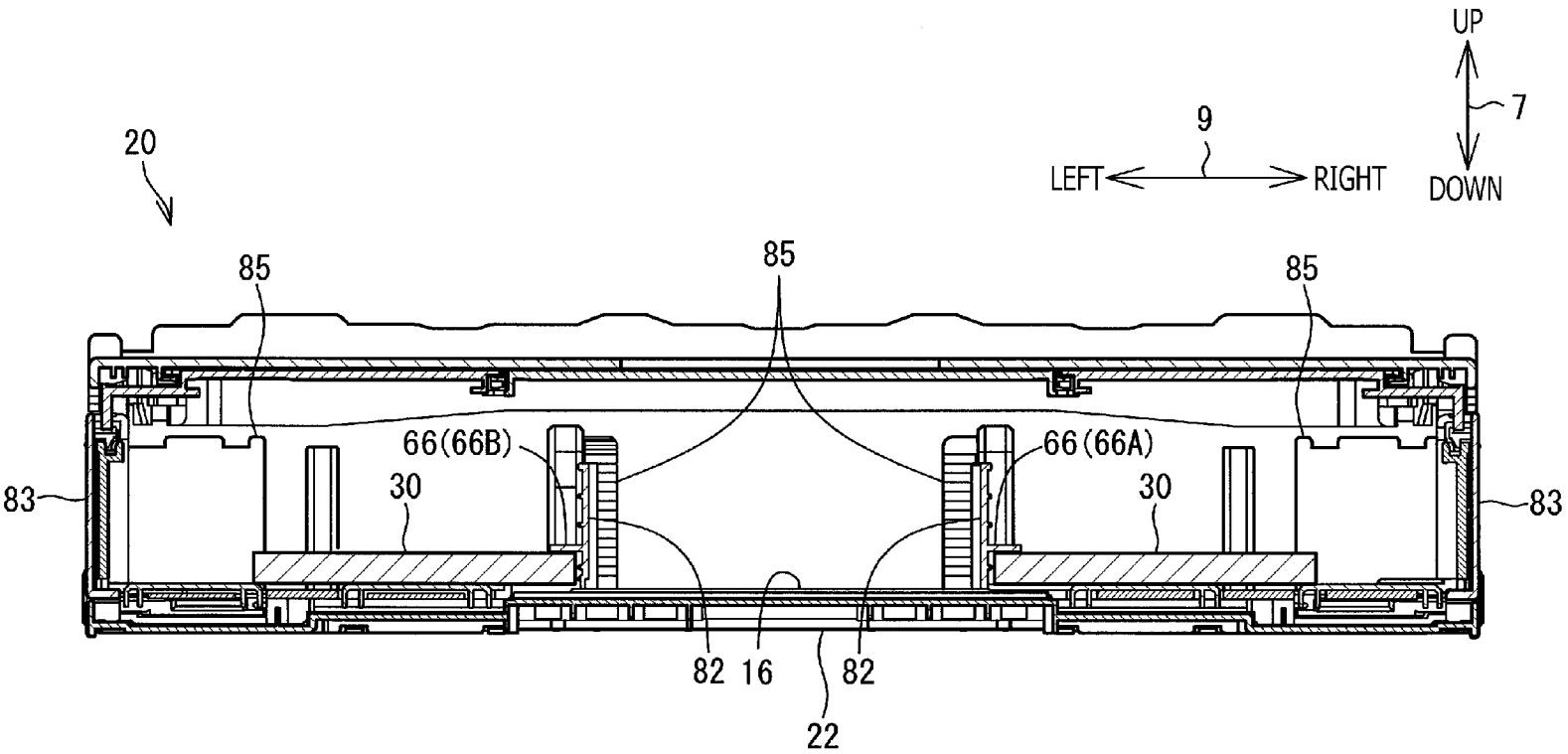

FIG. 10 is a cross-sectional view of the ink cartridge 30 and the feeder tray 20 according to another modified example of the present invention.

Figure 11A:
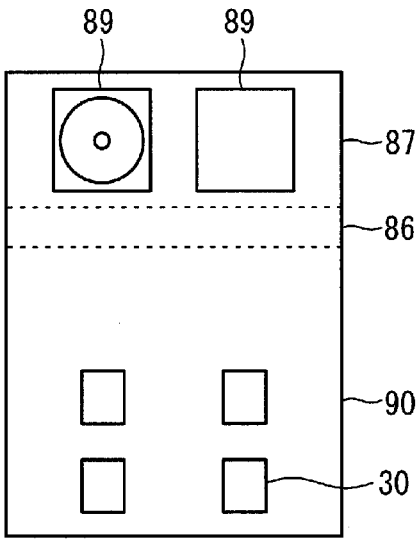
Figure 11B:
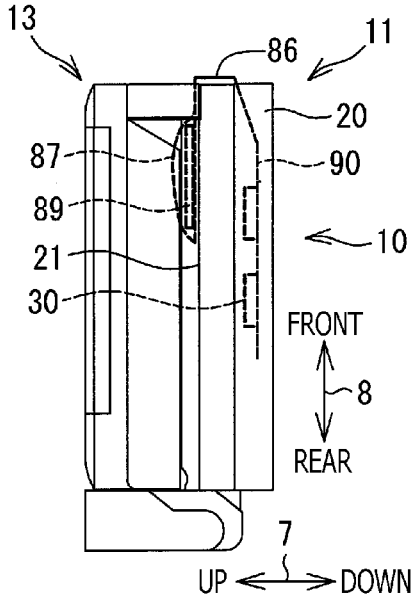
Figure 11C:
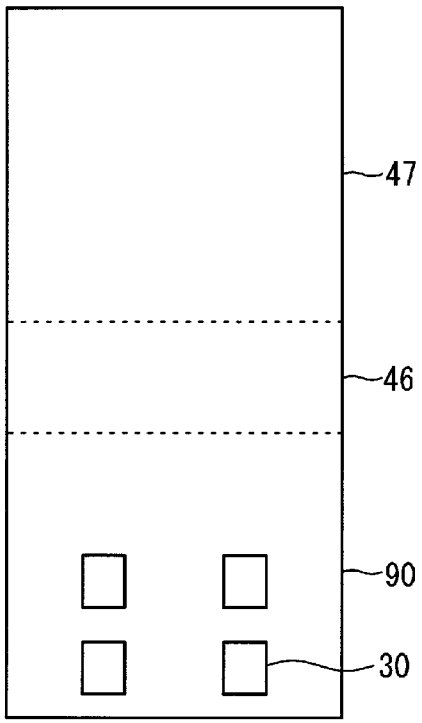
Figure 11D:
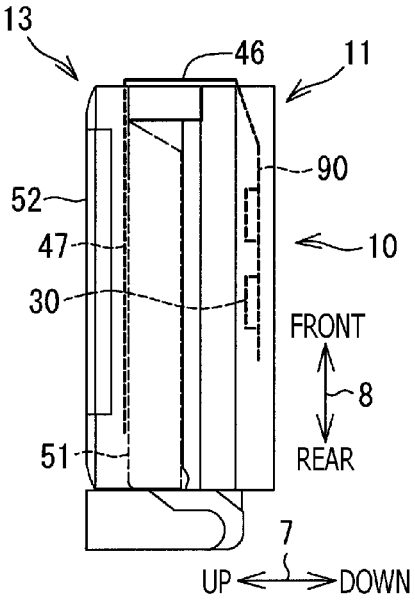

FIGS. 11A and 11C are plan views of an integrated piece including the ink cartridge container 90 according to modified examples of the present invention. FIGS. 11B and 11D are side views of the integrated piece placed in the MFD 10 in a shipping posture to be shipped out of a factory according to the modified examples of the present invention.

DETAILED DESCRIPTION

Hereinafter, embodiments according to aspects of the present invention will be described in detail with reference to the accompanying drawings. It is noted that various connections are set forth between elements in the following description. These connections in general, and unless specified otherwise, may be direct or indirect and that this specification is not intended to be limiting in this respect.

In the following description, a vertical direction 7 is defined with reference to an up-to-down or down-to-up direction for the MFD 10 in an ordinarily usable posture (see FIG. 1). In other words, the up-to-down or down-to-up direction in FIG. 1 coincides with the vertical direction 7. Further, other directions concerning the MFD 10 may be mentioned with regard to the ordinarily usable posture of the MFD 10: a viewer's lower-right side in FIG. 1, on which an opening 70 is formed, is defined to be a front side of the MFD 10, and a side opposite from the front side, i.e., a viewer's upper-left side, is defined as a rear side of the MFD 10. A front-to-rear or rear-to-front direction is defined as a direction of depth and may be referred to as a front-rear direction 8. A lower-left side in FIG. 1, which comes on the user's left-hand side with respect to the MFD 10 when the user faces the front side, is referred to as a left side or a left-hand side. A side opposite from the left, which is on the viewer's upper-right side, is referred to as a right side or a right-hand side. A right-to-left or left-to-right direction of the MFD 10 may also be referred to as a right-left direction 9 or a widthwise direction 9. The directions shown in FIGS. 1-3, 5, 10, and 11 correspond to those indicated by the arrows appearing in FIG. 1.

[Overall Configuration of the MFD 10]

Figure 1:
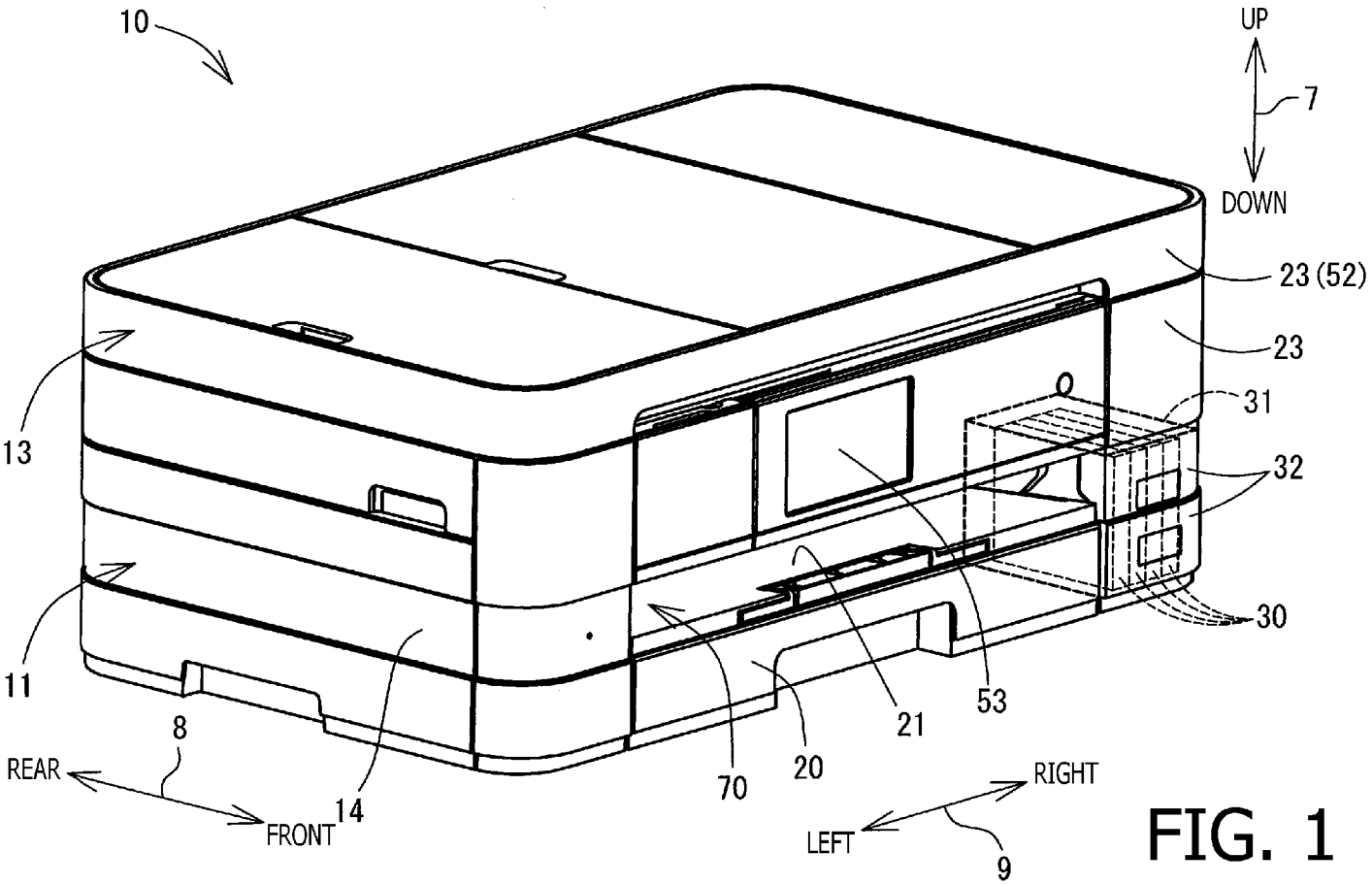
FIG. 1 is an external perspective view of a multifunction device (MFD) 10 according to an embodiment of the present invention.

As depicted in FIG. 1, the MFD 10 has an overall shape of a six-faced rectangular box and contains a scanner part 13 in an upper position thereof and a printer part 11 in a lower position thereof. The printer part 11 includes a printer casing 14, which is formed to have an approximate shape of a six-faced rectangular box. A liquid crystal touch-sensitive panel 53 is disposed on a front face of the printer casing 14. The liquid crystal touch-sensitive panel 53 displays information concerning operations of the MFD 10 and can be pressed by a user to manipulate the MFD 10. Meanwhile, the scanner part 13 includes a scanner casing 23, which is formed to have an approximate shape of a six-faced rectangular box.

The MFD 10 is a multi-functional device having a plurality of functions, including, for example, a facsimile transmission/receiving function and a printing function. The MFD 10 is equipped with the printing function to record an image on one side of a recording sheet 12 (see FIG. 2) in an inkjet-printing method. Optionally, the MFD 10 may be capable of printing both of two sides of the recording sheet 12.

[Feeder Tray 20]

Figure 2:
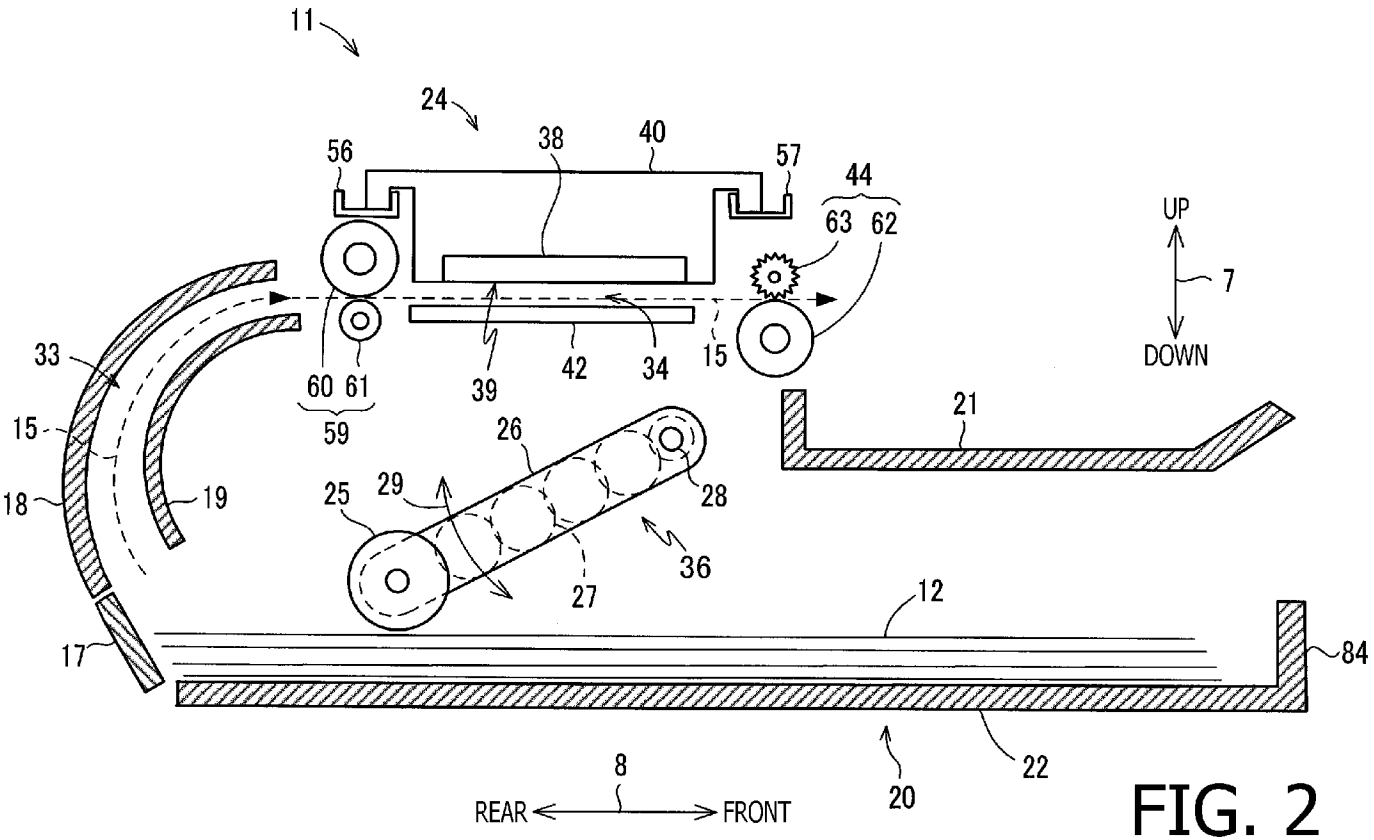
FIG. 2 is a cross-sectional view of an internal structure of a printer part 11 in the MFD 10 according to the embodiment of the present invention.

As depicted in FIG. 2, a feeder tray 20 is arranged in a lower position in the printer part 11. The feeder tray 20 is movable in the printer part 11 along the front-rear direction 8 to be attached to or detached from the printer casing 14. The feeder tray 20 has a shape of a top-open box.

As depicted in FIG. 3, the feeder tray 20 has a bottom plate 22, a pair of lateral plates 83, which rise upward from widthwise ends of the bottom plate 22, a front plate 84, which rises upward from a front end of the bottom plate 22, and rear protrusions 85, which rises from a rear end of the bottom plate 22. On an upper surface 16 of the bottom plate 22, one or more recording sheets 12 can be placed and supported in the feeder tray 20 by the bottom plate 22. When more than one recording sheets 12 are supported by the bottom plate 22, the recording sheets 12 are stacked along the vertical direction 7 to be placed on the bottom plate 22.

In lower rear positions in the printer casing 14, guide parts 17 are disposed. More specifically, the guide parts 17 are arranged in positions on a rear side of the bottom plate 22 of the feeder tray 20, when the feeder tray 20 is attached to the printer casing 14. Each of the guide parts 17 is arranged in an inclined posture, in which a lower side of the guide part 17 is in a frontward position and an upper side of the guide part 17 is in a rearward position. Each guide part 17 is formed to have a dent, which fits with the rear protrusion 85 when the feeder tray 20 is attached to the printer casing 14 (see FIG. 3).

In the feeder tray 20, a pair of lateral guides 82 are arranged to face each other along the widthwise direction 9 to rise upward from the upper surface 16 of the bottom plate 22. The paired lateral guides 82 are arranged to lie longitudinally along the front-rear direction 8. The paired lateral guides 82 are supported by the bottom plate 22 to be movable rightward and leftward, i.e., along the widthwise direction 9. The paired lateral guides 82 are coupled to each other by a known coupling mechanism such as a rack-and-pinion mechanism. With this mechanism, when one of the paired lateral guides 82 is moved in one orientation along the widthwise direction 9, the other of the paired lateral guides 82 is moved in an orientation opposite from the one orientation along the widthwise direction 9. While the paired lateral guides 82 are placed to contact widthwise ends of the recording sheet 12 supported by the bottom plate 22, a widthwise position of the recording sheet 12 along the widthwise direction 9 in the feeder tray 20 is determined.

As depicted in FIG. 1, the printer casing 14 has the opening 70, which is formed to recess rearward from a front face of the printer casing 14. The opening 14 accommodates the feeder tray 20 therein when the feeder tray 20 is attached to the printer casing 14, i.e., in a position shown in FIG. 1.

The discharge tray 21 is supported in the printer casing 14 in an upper-frontward position with respect to the feeder tray 20. The discharge tray 21 forms a bottom of the opening 70, while the feeder tray 20 is attached to the printer casing 14, i.e., while the feeder tray 20 is in the position shown in FIG. 1. The recording sheet 12 having an image recorded thereon by a recording unit 24, which will be described later in detail, is discharged in the discharge tray 21.

As will be described later in detail, when the MFD 10 is packed for shipping, ink cartridges 30 to accompany the MDF 10 are supported by the bottom plate 22 of the feeder tray 20 (see FIG. 3). In other words, the ink cartridges 30 are accommodated in the feeder tray 20. A method to pack the MFD 10 will be described later in detail.

[Feeder Unit 36]

As depicted in FIG. 2, in an upper position with respect to the feeder tray 20 being attached to the printer casing 14, arranged is the feeder unit 36. The feeder unit 36 includes a feed roller 25, a feeder arm 26, and a drive force transmission 27. The feed roller 25 is rotatably attached to one end of the feeder arm 26. The feeder arm 26 is pivotable about a shaft 28 disposed at the other end thereof in directions indicated by an arrow 29 to contact or to be separated from the feeder tray 20 or the recording sheet 12 supported by the bottom plate 22.

The feed roller 25 is rotatable by a driving force, which is generated by a conveyer motor (not shown) and transmitted through the drive force transmission 27 having a plurality of intermeshing gears. Thereby, when one or more recording sheets 12 are placed in the feeder tray 20, and when the feed roller 25 rotates, a topmost one of the recording sheets 12 placed in the feeder tray 20 is picked up and conveyed toward the rear side. In other words, the recording sheet 12 is conveyed toward the guide parts 17. The recording sheet 12 contacting the front faces of the guide parts 17 is guided along the inclination of the front faces of the guide parts 17 toward a curved path 33, which will be described later in detail. The feed roller 25 may optionally be rotated by a driving force, which is generated by a different motor separated from the conveyer motor.

[Curved Path 33 and Linear Path 34]

As depicted in FIG. 2, a curved path 33 and a linear path 34 extend from a rear end of the feeder tray 20 in the printer casing 14. The curved path 33 rises from the rear end of the feeder tray 20 and curves upper-frontward in the printer casing 14. The linear path 34 extends along the front-rear direction 8. The curved path 33 is formed by an outer guide member 18 and an inner guide member 19, which are arranged to face each other with a predetermined amount of clearance maintained in there-between. The linear path 34 is formed by the recording unit 24 and a platen 42, which are arranged to face each other with a predetermined amount of clearance maintained in there-between.

The recording sheet 12 supported by the bottom plate 22 of the feeder tray 20 is fed by the feeder roller 25 in the curved path 33 and conveyed through the curved path 33 and the linear path 34 along a conveying flow 15, which is indicated by a broken arrow shown in FIG. 2.

[Recording Unit 24]

As depicted in FIG. 2, the recording unit 24 is arranged in an upper position with respect to the linear path 34. In a lower position with respect to the recording unit 24 to face the recording unit 24 across the linear path 34, disposed is the platen 42 to support the recording sheet 12 being conveyed in the linear path 34.

The recording unit 24 includes a carriage 40 and recording heads 38. The carriage 40 is supported on guide rails 56, 57, which are arranged in positions spaced apart from each other along the front-rear direction 8, and is movable to reciprocate along the widthwise direction 9. The recording heads 38 are mounted on the carriage 40. The recording heads 38 are supplied with ink from the ink cartridge 30, which will be described later in detail. On a bottom surface of each recording head 38, nozzles 39 are formed. As the recording heads 38 are moved along the widthwise direction 9, the recording heads 38 selectively eject ink droplets onto the recording sheet 12, which is supported by the platen 42. Thus, an image is formed in the ink on the recording sheet 12.

[Ink Cartridges 30]

The ink cartridges 30 are reservoirs to store ink therein. As depicted in FIG. 3, each ink cartridge 30 is formed to have a shape of a parallelepiped, of which height (i.e., a dimension in the vertical direction 7 in FIG. 3) is relatively small compared to a depth or a width thereof. The ink cartridge 30 has a paired first faces 71 and a plurality of second faces 72, which connect edges of the paired first faces 71. As depicted in FIG. 1, when the MFD 10 is in usable condition, the ink cartridges 30 are attached to a cartridge mount 31, which is arranged in a frontward lower-right position in the printer casing 14. In the present embodiment, four (4) ink cartridges 30 are arranged to be spaced apart from one another along the widthwise direction 9. In this regard, the ink cartridges 30 are attached to the cartridge mount 31 to have the first faces 71 thereof to face one another along the widthwise direction 9. The quantity of the ink cartridges 30 to be attached to the cartridge mount 31 may not necessarily be limited to four but may be more or less than four.

A front panel 32 of the printer casing 14 located in a frontward position with respect to the cartridge mount 31 is openable and closable. The ink cartridges 30 can be inserted through an opening, which is exposed when the front panel 32 is open, to be installed in the printer casing 14. In rearward positions in the cartridge mount 31, ink-supplying needles (not shown) are disposed. When the ink cartridges 30 are inserted in the cartridge mount 31, ink-supplying ports (not shown) of the ink cartridges 30, which are formed at leading ends of the ink cartridges 30 with regard to the inserting direction, are pierced through by the ink-supplying needles. Thus, the ink-supplying needles are placed to reach ink reservoir chambers (not shown) in the ink cartridges 30. Meanwhile, ends of the ink-supplying needles, which are opposite from the piercing ends to pierce the ink cartridges 30, are connected with ends of ink tubes (not shown). Further, the ink tubes are connected with the recording heads 38 at the other ends opposite from the ink-supplying needles. Thus, the inks stored in the ink cartridges 30 can be conveyed and supplied to the recording heads 38 through the ink-supplying needles and the ink tubes.

[Conveyer Roller Pair 59 and Discharge Roller Pair 44]

As depicted in FIG. 2, a conveyer roller pair 59 is disposed on an upstream side of the recording unit 24 with regard to a conveying flow 15 in the linear path 34. Meanwhile, an discharge roller pair 44 is disposed on a downstream side of the recording unit 24 with regard to the conveying flow 15 in the linear path 34. The conveyer roller pair 59 includes a conveyer roller 60 and a pinch roller 61. The pinch roller 61 is urged against the conveyer roller 60 by a resilient member (not shown). The conveyer roller 60 and the pinch roller 61 are placed to contact each other and can nip the recording sheet 12 in there-between. The discharge roller pair 44 includes a discharge roller 62 and a spur 63. The discharge roller 62 is urged against the spur 63 by a resilient member (not shown). The discharge roller 62 and the spur 63 are placed to contact each other and can nip the recording sheet 12 in there-between.

The conveyer roller 60 and the discharge roller 62 are driven by a driving force from the conveyer motor (not shown). Thus, the conveyer roller pair 59 and the discharge roller pair 44 convey the nipped recording sheet 12 along the conveying flow 15.

[Scanner Casing 23]

As depicted in FIG. 1, the scanner casing 23 is disposed in an upper position with respect to the printer casing 14. A depth and a width of the scanner casing 23, i.e., dimensions along the front-rear direction 8 and the widthwise direction 9, are substantially equal to a depth and a width of the printer casing 14. Thus, the printer casing 14 and the scanner casing 23 form the parallelepiped shape of the MFD 10.

Inside the scanner casing 23, arranged are a piece of platen glass 51 (see FIG. 11D), on which an original document to be read is placed, and a reading unit, which includes an image sensor (not shown) to read the original document placed on the platen glass 51 from below. A cover 52 is disposed in an upper position with respect to the scanner casing 23. The cover 52 is pivotably rotatable about a rotation axis, which coincides with a rear end thereof or a rear end of the scanner casing 23. Thereby, a posture of the cover 52 is changeable between a covering position, in which the cover 52 covers the platen glass 51 from above, and an exposing position, which is in an upper position with respect to the covering position, and in which the platen glass 51 is exposed.

The original document with an image to be read can be placed on the platen glass 51 when the platen glass 51 is exposed. In this regard, the original document is placed with a side containing the image to be read facing downward, and the cover 52 is moved to the covering position to cover the original document and the platen glass 51. In this state, the image formed on the original document can be read by the image sensor.

The cover 52 may not necessarily be rotatable to be moved with respect to the scanner casing 23 but may be, for example, removed from and attached back to the scanner casing 23.

[Packing of MFD 10]

The MFD 10 can be packed in a shipping box (not shown), which is formed of, for example, cardboard, along with an intervening cushioning material (not shown). The cushioning material may be, for example, cellulose, cornstarch, cardboard, and/or styrene foam. In the present embodiment, the MFD 10 is placed in the shipping box in an upward orientation with a side with the opening 70, i.e., the front face, facing upward with regard to a direction of gravity force. In other words, when the direction of gravity force is referred to as a first direction, in the shipping box, the front face of the MFD 10 is placed in an upstream position with regard to the first direction while the remaining part of the MFD 10 is placed in a lower-stream positions.

When the MFD 10 is shipped, the ink cartridges 30 to accompany the MFD 10 are stored in an ink cartridge container 90 shown in FIG. 4A (see also FIG. 4B). The ink cartridge container 90 containing the ink cartridges 30 are supported by the bottom plate 22 of the feeder tray 20 (see FIG. 5).

[Ink Cartridge Container 90]

As depicted in FIG. 4A, the ink cartridge container 90 is a bag having an approximate shape of a vertically inverted "U" when viewed in a plan view. The ink cartridge container 90 has an opening 91 at a crosswise section (i.e., an upper part in FIG. 4A). A material for the ink cartridge container 90 may be, for example, polyethylene, polypropylene, polyester, and/or nylon.

The ink cartridge container 90 includes two container compartments 92, including a first compartment 93 and a second compartment 94, which are formed to accommodate the ink cartridges 30 therein. Further, the ink cartridge container 90 includes a bridging section 95, which connects end parts of the first and second compartments 93, 94 closer to the opening 91.

As shown in FIG. 4B, each of the first and second compartments 93, 94 can contain two (2) ink cartridges 30. However, the quantity of the ink cartridges 30 to be contained in each of the first and second compartments 93, 94 may not necessarily be limited to two. With the ink cartridges 30 being contained in the first and second compartments 93, 94, the bridging section 95 is folded and sealed by, for example, a piece of adhesive tape 96 or a stapler. Thereby, the opening 91 of the ink cartridge container 90 is closed, and the ink cartridges 30 can be prevented from falling out of the ink cartridge container 90.

The ink cartridge container 90 with the ink cartridges 30 contained therein, i.e., the ink cartridge container 90 in the state as shown in FIG. 4B, can be supported by the bottom plate 22 in the feeder tray 20 (see FIGS. 3 and 5). In FIGS. 3 and 10, it is to be noted that an image of the ink cartridge 90 is omitted.

Prior to placing the ink cartridge container 90 on the bottom plate 22 of the feeder tray 20, however, a packing worker may move the paired lateral guides 82 toward each other. Thereby, distances between the paired lateral guides 82 and the paired lateral plates 83 of the feeder tray 20 are enlarged, and the ink cartridges 30 can be placed on the bottom plate 22 with the first faces 71 facing upward.

The ink cartridge container 90 with the ink cartridges 30 placed on the bottom plate 22 is placed to be supported by the bottom plate 22. In this regard, the first compartment 93 is supported by the bottom plate 22 at a position between one of the lateral guides 82 on the left and the lateral plate 83 on the left, i.e., at a position opposite from the lateral guide 82 on the right with respect to the lateral guide 82 on the left. Meanwhile, the second compartment 94 is supported by the bottom plate 22 at a position between the other of the lateral guide 82 on the right and the lateral plate 83 on the right, i.e., at a position opposite from the lateral guide 82 on the left with respect to the lateral guide 82 on the right.

In other words, the first compartment 93 is supported by the bottom plate 22 at a position on an upstream side of the lateral guides 82 with regard to a rightward direction, and the second compartment 94 is supported by the bottom plate 22 at a position on a downstream side of the lateral guides 82 with regard to the rightward direction. In this regard, however, the rightward direction may optionally be reversed as long as the reversed direction is parallel to the widthwise direction 9: the first compartment 93 may be supported by the bottom plate 22 at a position on an upstream side of the lateral guides 82 with regard to a leftward direction, and the second compartment 94 may be supported by the bottom plate 22 at a position on a downstream side of the lateral guides 82 with regard to the leftward direction.

In this regard, the ink cartridges 30 contained in the ink cartridge container 90 are fitted in between the lateral guides 82 and the lateral plates 83; therefore, the ink cartridges 30 in the ink cartridge container 90 can be placed in correct widthwise positions along the widthwise direction 9 on the bottom plate 22.

As described above, while the container compartments 92 including the first compartment 93 and the second compartment 94 are supported by the bottom plate 22, the bridging section 95 is placed in a position between the paired lateral guides 82 and the front plate 84 of the feeder tray 20 along the front-rear direction 8 (see FIG. 5). In other words, the bridging section 95 is placed to be supported by the bottom plate 22 in a position on an upstream side of the lateral guides 82 with regard to the first direction.

In this regard, further, the bridging section 95 is placed to have a right-side end thereof in a rightward position beyond one of the lateral guides 82 on the right and to have a left-side end thereof in a leftward position beyond the other of the lateral guides 82 on the left with regard to the widthwise direction 9. In other words, in a condition when the container compartments 92 of the ink cartridge container 90 are supported by the bottom plate 22 in the feeder tray 20, the bridging section 95 is placed in a position to spread over the paired lateral guides 82 with regard to the widthwise direction 9.

Meanwhile, as mentioned above, the MFD 10 is packed in the shipping box with the front face having the opening 70 on the upper side with regard to the direction of gravity force. In this regard, the ink cartridge container 90 being supported by the feeder tray 20 (see FIG. 5) contacts the lateral guides 82 at the bridging section 95 from the upper side with regard to the direction of gravity force to hang down on the lateral guides 82.

Meanwhile, when the ink cartridge container 90 is in the condition shown in FIG. 4B, a length L of the container compartments 92 extending from the bridging section 95 is shorter than a distance between front ends of the lateral guides 82, when the feeder tray 20 is attached to the printer casing 14, and the guide parts 17. Therefore, when the ink cartridge container 90 is placed to be hooked on the lateral guides 82, the container compartments 92 float over the guide parts 17, in other words, the container compartments 92 are separated upward from the guide parts 17 with regard to the direction of gravity force.

[Usability]

According to the embodiment described above, the ink cartridge container 90 with the ink cartridges 30 contained therein can be stored in the feeder tray 20. In other words, the space in the feeder tray 20 can be used to store the ink cartridges 30. Therefore, it is not necessary to add or create an extra room to store the ink cartridges 30 other than the space to store body of the MDF 10 in the shipping box.

Further, the ink cartridge container 90 includes the bridging section 95. While the ink cartridge container 90 with the ink cartridges 30 contained therein is stored in the feeder tray 20 and supported by the bottom plate 22 of the feeder tray 20, and when external force or external shock attempts to move the ink cartridge container 90 toward the rear side of the MFD 10 (i.e., downward), the bridging section 95 is urged against the lateral guides 82. Thus, the ink cartridge container 95 can be restricted from being moved toward the rear side. Therefore, the ink cartridge container 90 may be stably maintained at the position in the proximity to the front face of the MFD 10.

According to the embodiment described above, the MFD 10 is stored in the shipping box with the front face thereof on the upper side with regard to the direction of gravity force. In this regard, the ink cartridge container 90 in the feeder tray 20 is placed to hang down on the lateral guides 82. Therefore, the ink cartridge container 90 may be prevented from being unhooked from the lateral guides 82 and from falling on the rear side of the MFD 10. Accordingly, the ink cartridge container 90 may be prevented from contacting the guide parts 17.

According to the embodiment described above, while the ink cartridge container 90 is hooked on the lateral guides 82, the bridging section 95 is in contact with the lateral guides 82. Thereby, the position of the ink cartridge container 90 hooked on the lateral guides 82 may be stably maintained.

According to the embodiment described above, while the ink cartridge container 90 being a bag has an uncomplicated structure, the ink cartridges 30 may be stored in the ink cartridge container 90 without difficulty.

Modified Example 1

In the embodiment described above, the pair of lateral guides 82 are provided; however, the pair of lateral guides 82 may be replaced with a single lateral guide (see FIG. 9A). With the single lateral guide 82, for example, the recording sheet 12 supported by the bottom plate 22 on the feeder tray 20 may be placed in a correct widthwise position along the widthwise direction 9 by having one of widthwise ends thereof to be in contact with the single lateral guide 82 and the other widthwise end thereof to be in contact with the lateral plates 83.

In this configuration according to the first modified example, an amount of the clearance between the first compartment 93 and the second compartment 94 along the widthwise direction 9 may be enough if the amount is longer than a dimension of the single lateral guide 82 along the widthwise direction. In other words, as shown in FIG. 9A, the amount of the clearance may be reduced to be smaller than the amount of clearance between the paired lateral guides 82, which is as shown in FIG. 4.

In this configuration according to the first modified example, further, while the container compartments 92 are supported by the feeder tray 20, the bridging section 95 is arranged in a position between the lateral guide 82 and the front plate 84 of the feeder tray 20. In other words, the bridging section 95 is in a position to spread over the lateral guide 82 with regard to the widthwise direction 9 when the container compartments 92 are supported by the bottom plate 22 of the feeder tray 20.

Modified Example 2

In the embodiment described above, the lateral guides 82 are disposed in the feeder tray 20, and the ink cartridge container 90 is stored to be hooked in the feeder tray 20. Alternately or additionally, the feeder tray 20 may be equipped with a rear guide (not shown) to restrict a position of a tail end of the recording sheet 12 to be placed in the feeder tray 20, and the ink cartridge container 90 may be hooked on the rear guide to be stored in the feeder tray 20.

In particular, the rear guide may be arranged to protrude upward from the upper surface 16 and restrict a position of the tail end of the recording sheet 12 supported by the bottom surface 22 of the feeder tray 20. The rear guide may be movable along the front-rear direction 8 on the bottom plate 22 in order to be able to restrict positions of tail ends of different-sized recording sheets, or the rear guide may be fixed onto the bottom plate 22.

Modified Example 3

In the embodiment described above, the ink cartridge container 90 is a bag; however, the ink cartridge container 90 may not necessarily be formed in a shape of a bag.

Figure 6B:
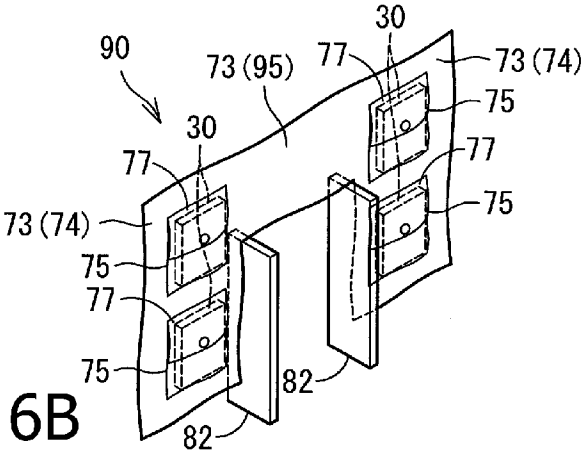
Figure 6D:
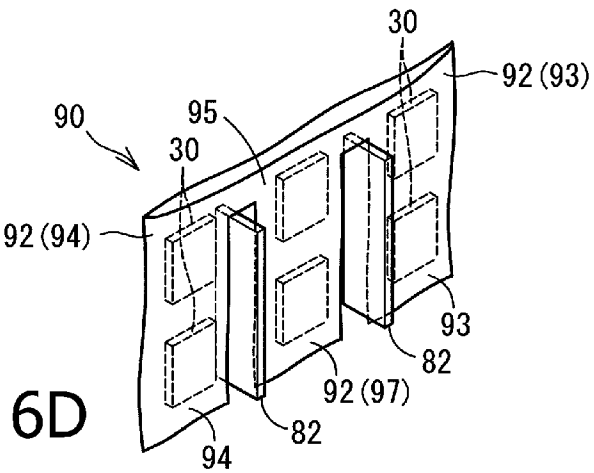
Figure 6A:
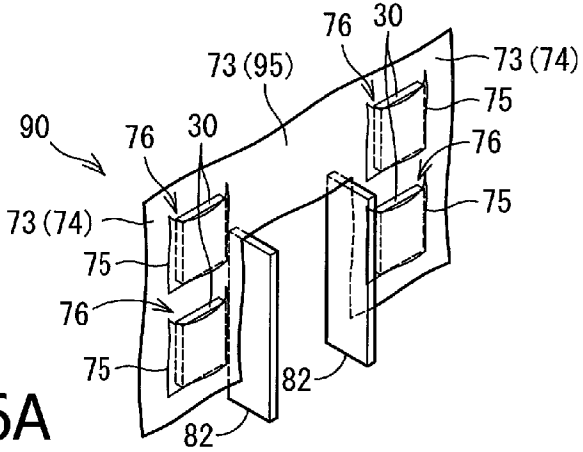
Figure 6C:
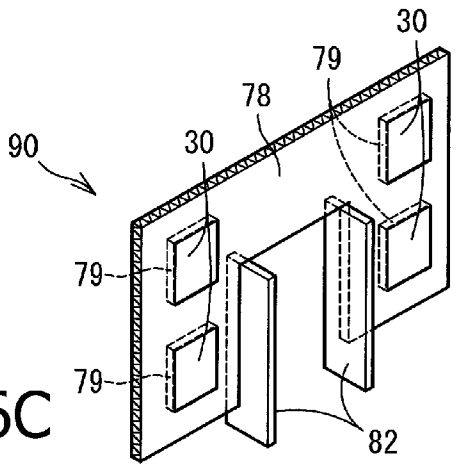

For example, as depicted in FIG. 6A, the ink cartridge 90 container may be formed to have a sheet of base 73 and pockets 75 arranged on the base 73. A material for the base 73 and the pockets 75 may be, for example, similarly to the ink cartridge container 90 described in the above embodiment, polyethylene, polypropylene, polyester, and/or nylon. A shape of the base 73 may be a vertically inverted "U" when viewed in a plan view, similarly to the ink cartridge container 90 described in the above embodiment. The base 73 is formed to have a pair of wings 74, which align side by side across a clearance, and a bridging section 95, which connects end parts of the wings 74. The pockets 75 are formed on the wings 74, and each of the pockets 75 has an opening 76 on the upstream side with regard to the front-rear direction 8, when the ink cartridge container 90 is supported by the bottom plate 22 in the feeder tray 20. The ink cartridges 30 can be inserted in the pockets 75 through the openings 76.

In the example shown in FIG. 6A, two pockets 75 are arranged on each of the wings 74; however a quantity or arrangement of the pockets may not necessarily be limited to those described above. Further, a sheet of the base 73 may rather be a board. For example, the base 73 may be made of cardboard. Furthermore, the material for the pockets 75 may not necessarily be limited to polyethylene, etc., but may be, for example, cardboard as well as the base 73.

According to the third modified example described above, the ink cartridges 30 can be stored in the pockets 75 separately from one another; therefore, the ink cartridges 30 can be prevented from conflicting with one another.

Optionally, as depicted in FIG. 6B, flaps 77 to cover the openings 76 of the pockets 75 may be provided. The flaps 77 may be placed to cover the openings 76 (see FIG. 6B) or flipped to expose the openings 76 (not shown). When the ink cartridges 30 are inserted in and removed from the pockets 76, the flaps 77 may be flipped to expose the openings 76. On the other hand, while the ink cartridges 30 are stored in the pockets 75, the flaps 77 may be placed over the openings 76.

Thus, with the flaps 77, of which postures are changeable between the open position and the covering position, the ink cartridges 30 can be prevented from falling out of the pockets 75.

Further, for another example, the ink cartridge container 90 may include a board of base 78 and fit-in portions 79. In this regard, a material for the base 78 may be, for example, cardboard. The fit-in portions 79 may be formed to have the ink cartridges 30 fitted therein, and may be in any configuration as long as the ink cartridges 30 can be fitted therein. For example, the fit-in portions 79 may be dents, which are formed to be slightly smaller than external dimensions of the ink cartridges 30. The dents formed in the cardboard may be resiliently deformed by the ink cartridges 30 when the ink cartridges 30 are pressed there-into so that the ink cartridges 30 can be closely fitted in the fit-in portions 79 to stay thereat.

According to the third modified example described above, the ink cartridges 30 may be stably fixed to the ink cartridge container 90 by fitting the ink cartridges 30 into the fit-in portions 79.

Modified Example 4

The shape of the ink cartridge container 90 may not necessarily be limited to the vertically inverted "U" (see FIG. 4A) when viewed in a plan view. For example, as depicted in FIG. 6D, the container compartments 92 may include a third compartment 97, in addition to the first compartment 93 and the second compartment 94. The third compartment 97 may protrude from the bridging section 97 in a position between the first compartment 93 and the second compartment 97.

The third compartment 97 may be, similarly to the first compartment 93 and the second compartment 94, capable of storing two ink cartridges 30; however, the quantity of the ink cartridges 30 to be stored in the third compartment 97 may not necessarily be limited to two. When the ink cartridge container 90 is supported by the bottom plate 22, the third compartment 97 is supported by the bottom plate 22 in the position between the paired lateral guides 82.

According to the fourth modified example described above, with the ink cartridge container 90 having the third compartment 97, the larger quantity of ink cartridges 30 may be stored in the feeder tray 20.

Modified Example 5

The ink cartridge container 90 may have solely one container compartment 92 (see FIG. 9B) rather than a plurality of container compartments 92. In FIG. 9B, the second compartment 94 represents the single container compartment 92; however, it may be the first compartment 93 that represents the single container compartment 92. The single container compartment 92 may be supported by the bottom plate 22 on the feeder tray 20 on either right or left side of the lateral guides 82. When the ink cartridge container 90 is formed in the shape shown in FIG. 9B, it may be desirable that the ink cartridge container 90 is equipped with a rigid member 99, which serves similarly to the bridging section 95 and provides higher rigidity than a base 80. The rigid member 99 will be described later in detail.

Further, as depicted in FIG. 7, the third compartment 97 described in the fourth modified example may serve as the single container compartment 92 in the ink cartridge container 90. According to FIG. 7, the third compartment 97 may contain six (6) ink cartridges 30 therein; however, the quantity of the ink cartridges 30 to be stored in the third compartment 97 may not necessarily be limited to six. A dimension of the third compartment 97 along the widthwise direction 9 may not be limited as long as the third compartment 97 is supported by the bottom plate 22 in the position between the paired lateral guides 82. When the ink cartridge container 90 is formed in the shape shown in FIG. 7, it may be desirable that the ink cartridge container 90 is equipped with the rigid member 99, which serves similarly to the bridging section 95 and provides higher rigidity than the base 80.

Modified Example 6

The shape of the ink cartridge container 90 may not necessarily be limited to the vertically inverted "U" (see FIG. 4A) when viewed in a plan view. For example, as depicted in FIG. 9C, the ink cartridge container 90 may have a shape of an overall rectangle when viewed in a plan view. In this regard, the ink cartridge container 90 may have a body 80, which has the rectangular shape and serves as the container compartment 92, and the rigid member 99, which serves as the bridging section 95. The rigid member 99 will be described later in Modified Example 7.

When the ink cartridge container 90 is formed to have the rectangular shape as shown in FIG. 9C, the ink cartridge container 90 may have joint portions 98. In FIG. 9C, the joint portions 98, where mutually facing inner surfaces of the body 80 are bonded with each other by, for example, being thermally pressed, are indicated by hatching Inner space of the body 80 is divided into a plurality of container compartments by the joint portions 98. In the plurality of divided container compartments, at least one ink cartridge 30 may be stored. In this regard, the ink cartridge container 90 may be placed in the feeder tray 20 in an arrangement such that the joint portions 98 substantially coincide with the lateral guides 82, as depicted in FIG. 9C.

According to the sixth modified example described above, while the ink cartridge container 90 is formed in a less complicated shape of rectangle, the ink cartridge container 90 may provide the plurality of divided container compartments 92 to store a plurality of ink cartridges 30 therein. Thereby, the ink cartridges 30 can be prevented from conflicting with one another in the ink cartridge container 90. Further, manufacturing cost for the ink cartridge container 90 may be reduced.

Modified Example 7

In the ink cartridge container 90, the bridging section 95 may be configured to be more rigid than the container compartments 92. For example, as shown in FIG. 7A, the ink cartridge container 90 may have a body 80 to serve as the container compartment 92 and a rigid member 99, of which rigidity is greater than rigidity of the body 80.

The rigid member 99 shown in FIG. 7A is a bar made of, for example, cardboard. The rigid member 99 is accommodated in the body 80, in a position closer to the opening 91 compared to the ink cartridges 30. When the ink cartridge container 90 is supported by the bottom plate 22 of the feeder tray 20, the rigid member 99 is placed in a frontward position with respect to the lateral guides 82. In this regard, the rigid member 99 is placed in a position to spread over the lateral guides 82 with regard to the widthwise direction 9. Thus, the rigid member 99 can contact the lateral guides 82 from the front. The opening 91 of the body 80, in which the ink cartridges 30 and the rigid member 99 are contained, may be sealed by, for example, an adhesive tape or a stapler.

Alternatively, the rigid member 99 may be made of, for example, a piece of cardboard which is bent along the widthwise direction 9 as shown in FIG. 7B. The rigid member 99 may be placed over the opening 91 of the ink cartridge container 90, in which the ink cartridges 30 are contained, as drawn in broken lines in FIG. 7B. At this position, the rigid member 99 may be attached to the ink cartridge container 90 by, for example, a stapler. Thereby, the rigid member 99 may contact the lateral guides 82 from the front while the ink cartridge container 90 is supported by the bottom plate 22 of the feeder tray 20.

According to the seventh modified examples described above, while the MFD 10 may be packed in the shipping box with the front face having the opening 70 on the upper side with regard to the direction of gravity force, the ink cartridge 90 being supported by the feeder tray 20 contacts the lateral guides 82 from the upper side with regard to the direction of gravity force to hang down on the lateral guides 82.

According to the seventh modified examples described above, further, the rigidity of the bridging section 95 is greater than the container compartment 92; therefore, it may be prevented that, when the bridging section 95 contacts the lateral guides 82, the bridging section 95 is separated from the lateral guides 82 and the ink cartridge container 90 is moved rearward. Moreover, while the MFD 10 is packed in the shipping box with the front face on the upper side with regard to the direction of gravity force and with the ink cartridge container 90 hanging on the lateral guides 82, it may be prevented that the bridging section 95 is deformed to be separated from the lateral guides 82 and the ink cartridge container 90 slips to fall downward.

Modified Example 8

As depicted in FIG. 8, a hole 60 or a plurality of holes 64 may be formed in the bridging section 95 of the ink cartridge container 90. Meanwhile, the lateral guides 82 may be formed to have projections 65, which project frontward from front portions of the lateral guides 82. Thereby, while the ink cartridge container 90 is supported by the bottom plate 22 of the feeder tray 20, the projections 65 may be placed to penetrate the bridging section 95 through the hole(s) 64. Thus, the ink cartridge container 90 may be hooked onto the lateral guides 82. With the hole(s) 64 and the projections 65, the rigid member 99 described in the seventh modified example may be omitted.

According to the eighth modified example, a shape of the hole(s) 64 may not necessarily be limited as long as the projections 65 can penetrate there-through. For examples, as depicted in FIG. 8A, a pair of round-shaped holes 64 may be formed for the paired lateral guides 82 so that each hole 64 and each of the paired lateral guides 82 correspond to each other. For another example, as depicted in FIG. 8B, a single hole 64, which is elongated along the widthwise direction 9 to allow the both of the paired projections 65 to penetrate there-through, may be formed.

According to the eighth modified example described above, while the projections 65 are placed to penetrate the bridging section 95 through the holes 64, the condition, in which the ink cartridge container 90 is hooked onto the lateral guides 82, can be maintained more easily.

Modified Example 9

The lateral guide 82 may be formed to have a projection 66, which protrudes along the widthwise direction 9. For example, as depicted in FIG. 10, the paired lateral guides 82 may be formed to have the projection 66, which includes a projection 66A and a projection 66B. The projection 66A may be formed to protrude rightward from a right-side face of the lateral guide 82 on the right, and the projection 66B may be formed to protrude leftward from a left-side face of the lateral guide 82 on the left.

The projection 66 may be formed in a position which is above the ink cartridges 30 contained in the ink cartridge container 90, while the ink cartridge container 90 is supported by the bottom plate 22 of the feeder tray 20. Therefore, the projection 66 may contact the ink cartridge container 90 from above while the ink cartridge container is supported by the bottom plate 22 of the feeder tray 20. Accordingly, the projection 66 may hold the ink cartridges 30 which are contained in the container compartment 92 of the ink cartridge container 90 from above.

According to the ninth modified example, with the projection 66 contacting the ink cartridge container 90 from above, the ink cartridges 30 contained in the ink cartridge container 90 may be held steadily in the position between the bottom plate 22 and the upper surface 16. Therefore, rattles of the ink cartridges 30 in the vertical direction 7 may be reduced or may be prevented.

Modified Example 10

The ink cartridge container 90 may be, as depicted in FIG. 11A, connected with a connector sheet 86 and an accessory container 87.

The connector sheet 86 may be connected with an end of the ink cartridge container 90 on a side of the bridging section 95, i.e., a front end of the ink cartridge container 90 when the ink cartridge container 90 is supported by the bottom platen 22 of the feeder tray 20. The connector sheet 86 may be made of, for example, polyethylene, polypropylene, polyester, and/or nylon.

Meanwhile, the accessory container 87 may be connected with the connector sheet 86 on the other end opposite from the ink cartridge container 90. The accessory container 87 may be made of, for example, polyethylene, polypropylene, polyester, and/or nylon. The accessory container 87 is formed in a shape of a bag having an opening (not shown) at the end on the side of the connector sheet 86. The accessory container 87 may contain accessories 89 of the MFD 10. The accessories 89 may be, for example, documents such as an operation manual of the MFD 10, and a memory medium such as a CD-ROM, in which software programs to be used to manipulate the MFD 10 are stored. With the accessories 89 contained inside the accessory container 87, the opening of the accessory container 87 may be sealed by, for example, an adhesive tape or a stapler.

The ink cartridge container 90, the connector sheet 86, and the accessory container 87 may be formed either integrally with one another or separately to be connected with one another integrally eventually.

The integrated piece of the ink cartridge container 90, the connector sheet 86, and the accessory container 87 may be placed in an arrangement shown in FIG. 11B when the MFD 10 is shipped. More specifically, the connector sheet 86 may be placed to project from the front face of the MFD 10 frontward through a clearance formed in between an upper end of the front plate 84 of the feeder tray 20 and the discharge tray 21. Meanwhile, a boundary portion between the ink cartridge container 90 and the connector sheet 86 and a boundary portion between the connector sheet 86 and the accessory container 87 may be curved or bent so that the accessory container 87 may be accommodated in the opening 70.

The MFD 10, in which the integrated piece is placed therein in the arrangement described above, may be packed in the shipping box in the upward orientation with the side with the opening 70 facing upward with regard to the direction of gravity force, similarly to the MFD 10 in the above-described embodiments. Thereby, the integrated piece may be placed to contact a front end of the discharge tray 21, which forms a part of the front face of the printer part 11, at the connector sheet 86 from above. Accordingly, the integrated piece may be placed in a condition to hang on the printer part 11.

According to the tenth modified example, the MFD 10, in which the ink cartridge container 90 and the accessory container 87 are accommodated in the feeder tray 20 and the opening 70 respectively, may be stored in the box in the upward orientation with the front face facing upward with regard to the direction of gravity force. In this regard, the integrated piece configured with the ink cartridge container 90, the connector sheet 86, and the accessory container 87 may be placed in the condition to hang on the printer part 11. Therefore, while the connector sheet 86 contacts the front face of the printer part 11, the ink cartridge container 90 may be restricted from falling downward.

Modified Example 11

The ink cartridge container 90 may be, as depicted in FIG. 11C, connected with a first sheet 46 and a second sheet 47.

The first sheet 46 may be connected with an end of the ink cartridge container 90 on a side of the bridging section 95, i.e., a front end of the ink cartridge container 90 while the ink cartridge container 90 is supported by the bottom platen 22 of the feeder tray 20. The first sheet 46 may be made of, for example, polyethylene, polypropylene, polyester, and/or nylon.

The ink cartridge container 90, the first sheet 46, and the second sheet 47 may be formed either integrally with one another or separately to be connected with one another integrally eventually.

The integrated piece of the ink cartridge container 90, the first sheet 46, and the second sheet 47 may be placed in an arrangement shown in FIG. 11D when the MFD 10 is shipped. More specifically, the first sheet 46 may be placed to project from the front face of the MFD 10 frontward through a clearance formed in between an upper end of the front plate 84 of the feeder tray 20 and the discharge tray 21.

Meanwhile, a boundary portion between the ink cartridge container 90 and the first sheet 46 may be curved or bent so that the first sheet 46 may stretch upward along front faces of the printer part 11 and the scanner part 13. On the other hand, a boundary portion between the first sheet 46 and the second sheet 47 may be curved or bent so that the second sheet 47 may contact an upper surface of the platen glass 51. In this condition, the cover 52 may be moved to rotate from the exposing position, in which the upper surface of the platen glass 51 is exposed, to the covering position, in which the cover 52 covers the platen glass 51 from above. Thereby, the second sheet 47 may be placed in a position between the platen glass 51 and the cover 52.

The MFD 10, in which the integrated piece is placed therein in the arrangement described above, may be packed in the shipping box in the upward orientation with the side with the opening 70 facing upward with regard to the direction of gravity force, similarly to the MFD 10 in the above-described embodiments. Thereby, the integrated piece may be placed to contact the front faces of the printer part 11 and the scanner part 13 at the first sheet 46 from above. Accordingly, the first sheet 46 may contact the liquid crystal touch-sensitive panel 53, which is disposed on the front face of the printer part 11.

Thus, the integrated piece may be placed in a condition to hang on the MFD 10.

According to the eleventh modified example, the MFD 10, in which the ink cartridge container 90 is accommodated in the feeder tray 20 and the second sheet 47 is placed in the position between the platen glass 51 and the cover 52, may be stored in the box in the upward orientation with the front face facing upward with regard to the direction of gravity force. In this regard, the integrated piece configured with the ink cartridge container 90, the first sheet 46, and the second sheet 47, may be placed in the condition to hang on the front face of the MFD 10. Therefore, while the first sheet 46 contacts the front face of the MFD 10, the ink cartridge container 90 may be restricted from falling downward. Moreover, while the second sheet 47 may contact the platen glass 51, the platen glass 51 may be protected by the second sheet 47 from damaging.

Further, according to the eleventh modified example, with the first sheet 46 contacting the liquid crystal touch-sensitive panel 53, the liquid crystal touch-sensitive panel 53 may be protected by the first sheet 46.

Modified Example 12

In the embodiments described above, the MFD 10 is packed in the shipping box in the upward orientation with the face having the opening 70 facing upward with regard to the direction of gravity force. However, the MFD 10 may be packed in a different orientation. For example, the MFD 10 may be packed in the shipping box with a side of the cover 52 facing upward with regard to the direction of gravity force.

In this orientation, while the MFD 10 is packed in the box, the ink cartridge container 90 may not hang on the lateral guides 82. However, with the bridging section 95 contacting the lateral guides 82 from above with regard to the direction of gravity force, the ink cartridge container 90 may be restricted from moving rearward. Accordingly, the ink cartridge container 90 may be prevented from contacting the guide parts 17.

Although examples of carrying out the invention have been described, those skilled in the art will appreciate that there are numerous variations and permutations of the inkjet recording apparatus, the multifunction device, and the ink cartridge container that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An inkjet recording apparatus, comprising:

an ink cartridge;

an ink cartridge container configured to contain the ink cartridge therein;

a tray comprising a supporting surface configured to support one of a sheet and the ink cartridge container containing the ink cartridge; and a slider member configured to protrude from the supporting surface in the tray along a direction orthogonal to the supporting surface, the slider member being configured to be slidable on the supporting surface along one of a first direction and a second direction, the first direction being an orientation from a front side toward a rear side of the inkjet recording apparatus, and the second direction being an orientation orthogonal to the first direction, wherein the ink cartridge container comprises:

a container compartment, in which the ink cartridge is contained, in a position on at least one of an upstream side and a downstream side of the slider member with regard to the second direction; and a bridging section connected with the container compartment, the bridging section being placed on an upstream side of the slider member with regard to the first direction in a position to spread over the slider member with regard to the second direction.

2. The inkjet recording apparatus according to claim 1, further comprising:

a feeder unit configured to convey the sheet supported by the tray in the first direction; and a guide part disposed on a downstream side of the sheet with regard to the first direction and configured to contact and guide the sheet conveyed by the feeder unit, wherein the container compartment comprises a first compartment configured to be supported by the tray on the upstream side of the slider member with regard to the second direction and a second compartment configured to be supported by the tray on the downstream side of the slider member with regard to the second direction;

wherein the bridging section connects the first compartment and the second compartment with each other; and wherein, when the inkjet recording apparatus is packed in an upward orientation having the upstream side of the slider member with regard to the first direction facing upward with regard to a direction of gravity force, the bridging section of the ink cartridge container is placed to spread over the slider member with regard to the second direction.

3. The inkjet recording apparatus according to claim 2, wherein the slider member comprises a paired slider members which are arranged to face each other along the second direction;

wherein the first compartment is supported by the tray on one side of one of the paired slider members in a position opposite from the other one of the paired slider member;

wherein the second compartment is supported by the tray on one side of the other one of the paired slider members in a position opposite from the one of the paired slider members; and wherein, when the inkjet recording apparatus is packed in the upward orientation, the bridging section of the ink cartridge container is placed to spread over the paired slider member with regard to the second direction.

4. The inkjet recording apparatus according to claim 3, wherein the container compartment of the ink cartridge container comprises a third compartment, the third compartment being configured to be supported by the tray in a position between the paired slider members.

5. The inkjet recording apparatus according to claim 1, wherein the container compartment of the ink cartridge container is a bag.

6. The inkjet recording apparatus according to claim 5, wherein the ink cartridge container comprises a joint portion, at which mutually facing inner surfaces of the bag are bonded to divide the container compartment into a plurality of compartments.

7. The inkjet recording apparatus according to claim 1, wherein the container compartment comprises a base, the base being in a form of one of a sheet and a board, and a pocket arranged on the base, the pocket having an opening on an upstream side with regard to the first direction.

8. The inkjet recording apparatus according to claim 7, wherein the pocket comprises a flap, of which posture is changeable between an open position to expose the opening and a covering position to cover the opening.

9. The inkjet recording apparatus according to claim 1, wherein the container compartment comprises a base, the base being in a form of a board, and a fit-in portion formed in the base and in which the ink cartridge is fitted in.

10. The inkjet recording apparatus according to claim 1, wherein the bridging section is configured to be more rigid than the container compartment.

11. The inkjet recording apparatus according to claim 1, wherein the slider member comprises a projection, the projection being formed to project from an upstream end of the slider member with regard to the first direction toward a further upstream with regard to the first direction; and wherein the bridging section of the ink cartridge container comprises a hole, through which the projection is configured to penetrate.

12. The inkjet recording apparatus according to claim 1, wherein the slider member is formed to comprise a contact portion, the contact portion being configured to project toward an end of the tray along the second direction and contact the container compartment supported by the tray along the direction orthogonal to the supporting surface.

13. The inkjet recording apparatus according to claim 1, further comprising:

a casing with an opening formed to recess from the front side toward the rear side of the inkjet recording apparatus in an upper position than the tray along the direction orthogonal to the supporting surface;

a connector sheet configured to be connected with an upstream end of the ink cartridge container supported by the tray with regard to the first direction, the connector sheet stretching frontward of the inkjet recording apparatus from an upstream end of the tray with regard to the first direction; and an accessory container connected with the connector sheet on an opposite side from the ink cartridge container, the accessory container being configured to contain an accessory that accompanies the inkjet recording apparatus, wherein, when the inkjet recording apparatus is packed in an upward orientation having the upstream side of the slider member with regard to the first direction facing upward with regard to a direction of gravity force, the connector sheet covers a part of a front face of the inkjet recording apparatus.

14. A multifunction device, comprising:

an inkjet recording apparatus comprising:

an ink cartridge;

an ink cartridge container configured to contain the ink cartridge therein;

a tray comprising a supporting surface configured to support one of a sheet and the ink cartridge container containing the ink cartridge; and a slider member configured to protrude from the supporting surface in the tray along a direction orthogonal to the supporting surface, the slider member being configured to be slidable on the supporting surface along one of a first direction and a second direction, the first direction being an orientation from a front side toward a rear side of the inkjet recording apparatus, and the second direction being an orientation orthogonal to the first direction, wherein the ink cartridge container comprises:

a container compartment, in which the ink cartridge is contained, in a position on at least one of an upstream side and a downstream side of the slider member with regard to the second direction; and a bridging section connected with the container compartment, the bridging section being placed on an upstream side of the slider member with regard to the first direction in a position to spread over the slider member with regard to the second direction;

wherein the multifunction device further comprises:

a scanner disposed in an upper position than the inkjet recording apparatus along the direction orthogonal to the supporting surface, the scanner comprising a platen glass, the platen glass being configured to support a sheet, and a cover, of which posture is changeable between a covering position to cover an upper side of the platen glass and an exposing position to expose the upper side the platen glass with regard to the direction orthogonal to the supporting surface;

a first sheet configured to be connected with an upstream end of the ink cartridge container supported by the tray with regard to the first direction, the connector sheet projecting frontward of the inkjet recording apparatus from an upstream end of the tray with regard to the first direction to stretch upward along the direction orthogonal to the supporting surface; and a second sheet connected with the first sheet on an opposite side from the ink cartridge container, the second sheet being placed in a position between the platen glass and the cover, wherein, when the multifunction device is packed in an upward orientation having the upstream side of the slider member with regard to the first direction facing upward with regard to a direction of gravity force, the first sheet covers a part of a front face of the inkjet recording apparatus.

15. The multifunction device according to claim 14, further comprising:

a panel disposed on the front face of the inkjet recording apparatus, wherein the first sheet is in contact with the panel.

16. An ink cartridge container configured to contain ink cartridges for an inkjet recording apparatus, the inkjet recording apparatus comprising a sheet tray to support the ink cartridge container, the sheet tray comprising a supporting surface and a slider member, the sheet tray being configured to support the ink cartridge container containing the ink cartridge, the slider member configured to protrude from the supporting surface in the sheet tray along a direction orthogonal to the supporting surface, the slider member being configured to be slidable on the supporting surface along one of a first direction and a second direction, the first direction being an orientation from a front side toward a rear side of the inkjet recording apparatus, and the second direction being an orientation orthogonal to the first direction, the ink cartridge container comprising:

a plurality of container compartments configured to contain the ink cartridges therein; and a bridging section configured to connect the plurality of container compartments with one another, wherein the ink cartridge container is supported by the sheet tray in a position on an upstream side and a downstream side of the slider member with regard to the second direction; and wherein the bridging section is placed on an upstream side of the slider member with regard to the first direction in a position to spread over the slider member with regard to the second direction.

* * * * *

UNITED STATES PATENT AND TRADEMARK OFFICE

CERTIFICATE OF CORRECTION

PATENT NO. : 9,073,332 B2
APPLICATION NO. : 14/501336
DATED : July 7, 2015
INVENTOR(S) : Yasuo Nishikawa It is certified that error appears in the above-identified patent and that said Letters Patent is hereby corrected as shown below:

On The Title Page, insert:

-- (30) Foreign Application Priority Data

Dec. 6, 2013 (JP) ..... 2013-253683 --

Signed and Sealed this
Sixteenth Day of February, 2016

Michelle K. Lee

Michelle K. Lee
*Director of the United States Patent and Trademark Office*